US008073351B2

(12) United States Patent
Hayamizu

(10) Patent No.: US 8,073,351 B2
(45) Date of Patent: Dec. 6, 2011

(54) IMAGE FORMING DEVICE

(75) Inventor: Hitoshi Hayamizu, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 356 days.

(21) Appl. No.: 12/319,257

(22) Filed: Jan. 5, 2009

(65) Prior Publication Data

US 2009/0180792 A1 Jul. 16, 2009

(30) Foreign Application Priority Data

Jan. 10, 2008 (JP) ..... 2008-003629

(51) Int. Cl.
*G03G 15/20* (2006.01)

(52) U.S. Cl. ..... 399/67

(58) Field of Classification Search ..... 399/67
See application file for complete search history.

(56) References Cited

U.S. PATENT DOCUMENTS 6,647,216 B2 * 11/2003 Tanaka ..... 399/21

FOREIGN PATENT DOCUMENTS

JP 6-337612 12/1994
JP 2000221818 A * 8/2000

* cited by examiner

*Primary Examiner* — David Gray
*Assistant Examiner* — Erika J Villaluna
(74) *Attorney, Agent, or Firm* — Jordan and Hamburg LLP

(57) ABSTRACT

An image forming device includes: a fixing portion including a nip that is formed between a heat roller and a back-up roller pressurized by a pressurizing mechanism and holds and conveys a toner-bearing sheet; a pressure switching mechanism for changing a pressurizing force of the pressurizing mechanism; and a sheet detecting portion for detecting a sheet conveyed to the fixing portion. The sheet detecting portion changes a state of sheet detection by the sheet detecting portion in tandem to operation of the pressure switching mechanism. The image forming device includes a pressurization state determining portion for determining a state of pressurization of the pressurizing mechanism on the basis of an output of the sheet detecting portion for a sheet non-passing time, and a pressurization state display portion for displaying the pressurization state determined by the pressurization state determining portion.

4 Claims, 9 Drawing Sheets

| Pressurizing force | Sheet state | Sensing portion of the photosensor | Output of the sheet detecting portion |
|---|---|---|---|
| Small | No sheet exists (sheet non-passing time) | Shielded from light | H |
| | Sheet exists (sheet passing time or jam occurrence time) | Released | L |
| Large | No sheet exists (sheet non-passing time) | Released | L |
| | Sheet exists (sheet passing time or jam occurrence time) | Shielded from light | H |

Fig.5A

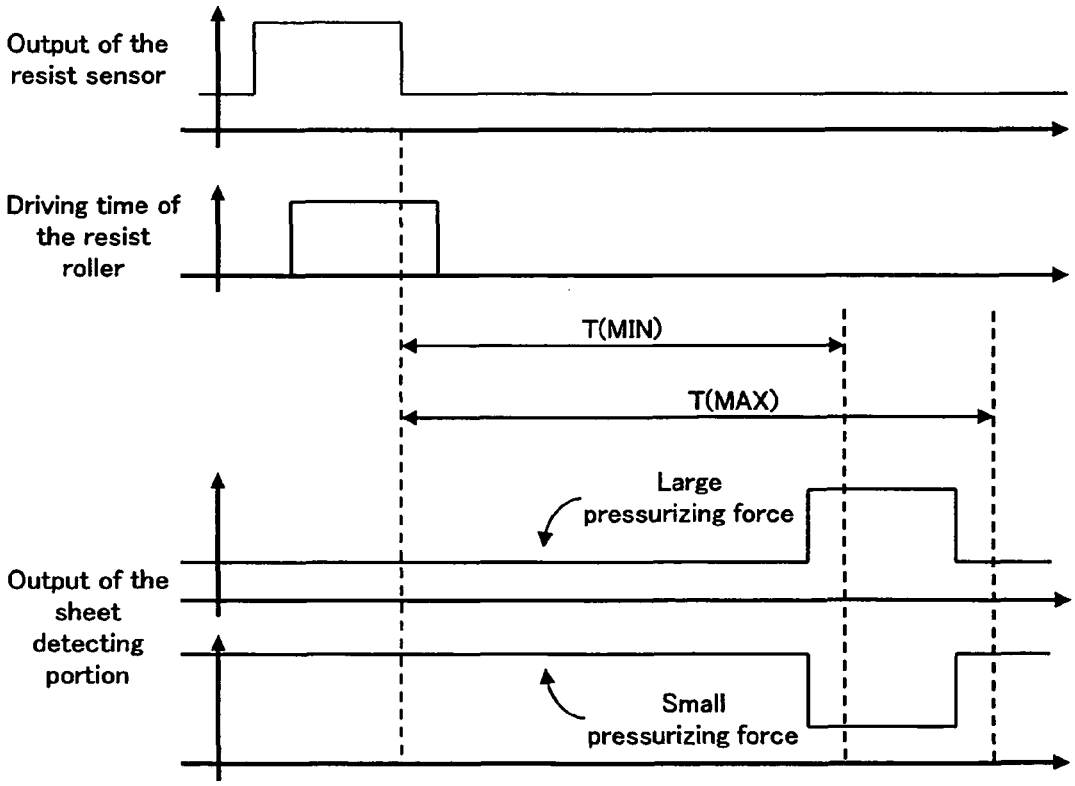

Fig.5B

IMAGE FORMING DEVICE

This application is based on an application No. 2008-003629 filed in Japan, the contents of which are hereby incorporated by reference.

BACKGROUND OF THE INVENTION

1. Field of the Invention

The present invention relates to an image forming device including a fixing portion including a nip that is formed between a heat roller and a back-up roller pressurized by a pressurizing mechanism and holds and conveys a toner-bearing sheet while fixing toner thereto, a pressure switching portion for switching the pressurizing force of the pressing mechanism between a strong force and a weak force, and a sheet detecting portion for detecting a sheet conveyed to the fixing portion.

2. Description of the Related Art

Heat roller-type fixers provided in electrophotographic image forming devices each include a heat roller heated to a predetermined temperature by a heater mounted inside the heat roller and a back-up roller pressed into contact with the heat roller.

The heat roller and the back-up roller are pressurized by a pressurizing mechanism to form a nip that holds a sheet, thus conveying it while fixing toner thereto.

Since suitable nip pressure varies depending on the kind of sheet passed through the fixing portion, image forming devices configured to be able to change the nip pressure depending on the kind of sheet have been conventionally proposed.

For example, Japanese Unexamined Patent Publication No. 6-337612 describes an image forming device including a fixing portion configured to hold and convey a record material while fixing an unfixed image thereto with a heat roller and a back-up roller, characterized in that the fixing portion is user operable and has a lever switchable between a first position at which normal nip pressure is effected to the heat roller and the back-up roller and a second position at which nip pressure for special paper is effected to the rollers.

Such an image forming device enables an operator to switch the nip pressure to the heat roller and the back-up roller by handling the lever in accordance with the kind of sheet.

The image forming device described in the JP6-337612 publication involves laborious handling when checking the current nip pressure; the operator has to open the cover of the device and check the position of the lever.

Convenience for the operator improves when the image forming device includes an actuator that operates in tandem to the lever and a pressurization state sensor including a photosensor for detecting the posture of the actuator so that the state of the nip pressure is automatically displayed on a display portion or the like of the image forming device on the basis of an output signal from the sensor.

However, adding the sensor to the image forming device is not preferable in that the manufacturing cost increases.

SUMMARY OF THE INVENTION

In view of the foregoing problems, an object of the present invention is to provide an image forming device that cheaply configures a device for detecting the pressurization state of the fixing portion pressurized by a pressurizing mechanism and displays the pressurization state detected by the device.

In order to accomplish the above object, the image forming device according to the present invention includes a fixing portion including a nip that is formed between a heat roller and a back-up roller pressurized by a pressurizing mechanism and holds and conveys a toner-bearing sheet, a pressure switching mechanism for changing a pressurizing force of the pressurizing mechanism, and a sheet detecting portion for detecting a sheet conveyed to the fixing portion. The image forming device is characterized in that the sheet detecting portion changes a state of sheet detection by the sheet detecting portion in tandem to operation of the pressure switching mechanism, and characterized in including: a pressurization state determining portion for determining a state of pressurization of the pressurizing mechanism on the basis of an output of the sheet detecting portion for a sheet non-passing time; and a pressurization state display portion for displaying the pressurization state determined by the pressurization state determining portion.

The present invention will become more apparent in the detailed description of the preferred embodiments presented below.

BRIEF DESCRIPTION OF THE DRAWINGS

FIG. 5A is a diagram for illustrating an output signal of the sheet detecting portion, and FIG. 5B is a diagram for illustrating an output signal of the sheet detecting portion for a sheet passing time;

DESCRIPTION OF THE PREFERRED EMBODIMENTS

Embodiments of an image forming device to which the present invention is applied will be described below by referring to an electrophotographic printer.

Figure 2:
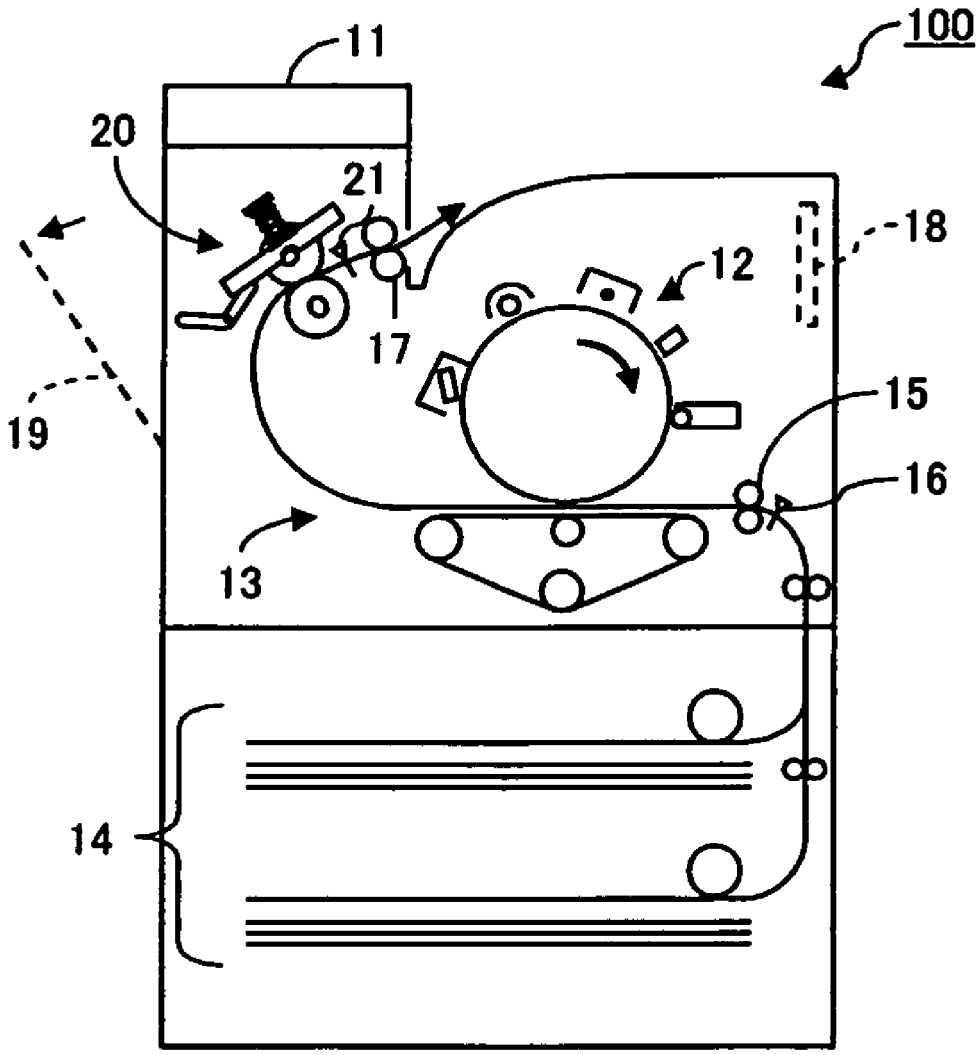
FIG. 2 is a diagram for illustrating a printer.

Referring to FIG. 2, a printer 100 includes an operation portion 11, an image forming portion 12, a sheet conveying portion 13, a fixing portion 20, and a system control portion 18 that assumes general control of these portions.

The operation portion 11 includes a plurality of hardware keys and a display portion using a liquid crystal panel or the like and functions as a man-machine interface.

The image forming portion 12 includes a photoreceptor, a charging device, an exposure device, and a developing device, which are arranged surrounding the photoreceptor. The image forming portion 12 forms a toner image on the basis of image data input through a network or the like and transfers the toner image to a conveyed sheet.

The sheet conveying portion 13 conveys a sheet from a paper drawer 14 to the image forming portion 12.

The fixing portion 20 holds and conveys the sheet bearing the toner image formed by the image forming portion 12 in order to fix the toner image to the sheet.

The system control portion 18 is composed of a print board mounting thereon a micro computer including a CPU, a ROM that stores an operation program of the CPU, and RAM that serves as a working area for the CPU, so that the system control portion 18 generates a print by controlling the portions of the printer 100 on the basis of an algorithm specified by the operation program.

Figure 3:
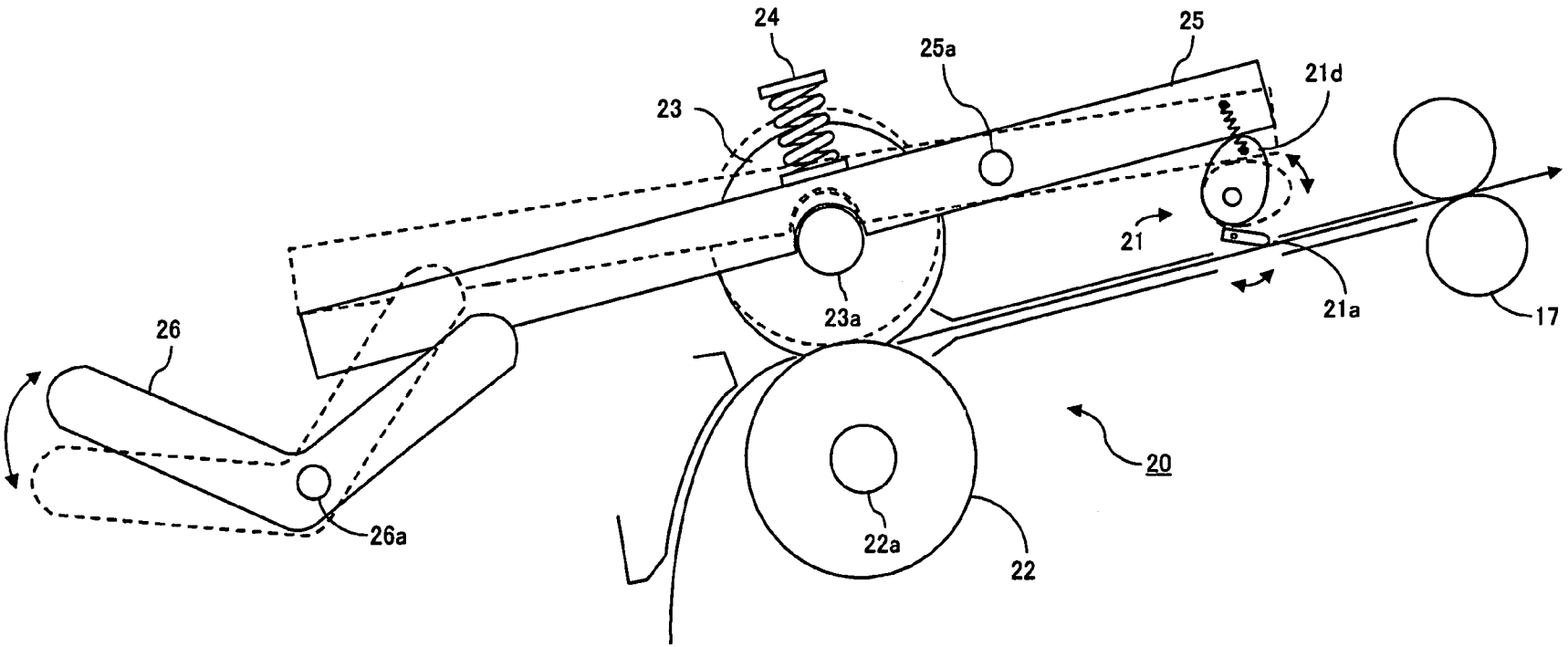
FIG. 3 is a diagram for illustrating a fixing portion.

Referring to FIG. 3, the fixing portion 20 includes a heat roller 22, a back-up roller 23, and a pressurizing mechanism 24 and 25.

The heat roller 22 rotates about a shaft 23a and incorporates a heater such as a halogen lamp. The heat roller 22 is heated to a predetermined temperature when the system control portion 18 controls to turn on and off the heater.

The back-up roller 23 and the heat roller 22 are pressed into contact with one another by the pressurizing force of the pressurizing mechanism 24 and 25, thus forming a nip at the portion of contact of the rollers.

The nip between the heat roller 22 and the back-up roller 23 pressurized by the pressurizing mechanism 24 and 25 holds a sheet in order to convey the sheet while fixing a toner image thereto. The sheet passing through the fixing portion 20 is discharged outside the device by discharge rollers 17.

The pressurizing mechanism includes springs 24 and pressurizing levers 25 located on the front side and rear side of the printer 100.

The springs 24 are fixed to the casing of the printer 100 at one end and to respective pressurizing levers 25 at the other end. The springs 24 press the pressurizing levers 25 in a direction to increase the nip pressure of the heat roller 22 and the back-up roller 23. The pressurizing levers 25 rock about pivots 25*a* and pressurize a bearing portion 23*a* of the heat roller 22 at a depressed portion formed on the lower surface of each pressurizing lever 25.

The pressurizing mechanism 24 and 25 includes a pressure switching mechanism 26 operable by the operator. Fixability is improved in such a manner that in the case of printing on an envelope and a thin sheet of paper, the pressure switching mechanism 26 is operated to lessen the pressurizing force, while in the case of printing on a thick sheet of paper, the pressure switching mechanism 26 is operated to increase the pressurizing force.

Referring to FIG. 2, sheet sensors 16 and 21 serving as sheet detecting portions are located in the vicinity of resist rollers 15 and in the vicinity of the fixing portion 20. The resist rollers 15 are for correcting a skew of sheet and making the front edge of a toner image and the front edge of the sheet agree to one another, and are controlled and driven by the system control portion.

Figure 4A:
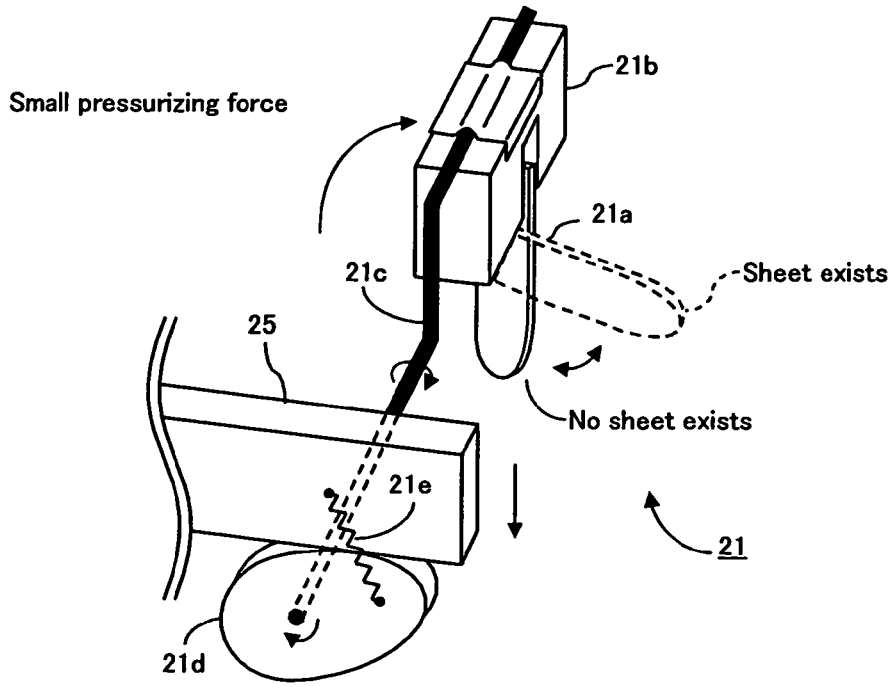
FIG. 4A is a diagram for illustrating a sheet detecting portion in the case of a small pressurizing force.

Referring to FIG. 4A, the sheet sensors 16 and 21 are each composed of an actuator 21*a* whose posture is changeable depending on the conveyed sheet and a transmission type photosensor (hereinafter referred to as "photosensor") 21*b* that detects a change in posture of the actuator 21*a*.

The actuator 21*a* is rotatably mounted in the direction of the sheet convey pathway so that during a sheet non-passing time, the actuator 21*a* keeps its posture vertical by its own weight while during a sheet passing time, the actuator 21*a* is pushed by the passing sheet to a posture inclined in the downstream direction of conveyance.

The photosensor 21*b* includes a sensing portion composed of a light emitting portion and a light receiving portion and is arranged such that a part of the actuator (a part of the portion upper than the rotation axis) is located in the sensing portion by a change in the posture of the actuator 21*a*. Thus, output signals of the sheet sensors 16 and 21 vary depending on whether a conveyed sheet exists.

While in the present embodiment the photosensor outputs a signal of level "H" when the sensing portion is shielded from light and a signal of level "L" when the sensing portion is released, the output logic may be set in reverse. This may be changed conveniently depending on the specification of the image forming device.

The system control portion 18 determines whether a jam has occurred on the basis of the period of time between the time when the sheet sensor 16 (hereinafter referred to as "resist sensor") provided in the vicinity of the resist rollers 15 detects a sheet conveyed through the sheet conveying portion 13 and the time when the sheet sensor 21 provided in the vicinity of the fixing portion 20 detects this sheet. When determining that a jam has occurred, the system control portion 18 makes a display on the display portion of the operation portion 11 informing that a jam has occurred.

Figure 1:
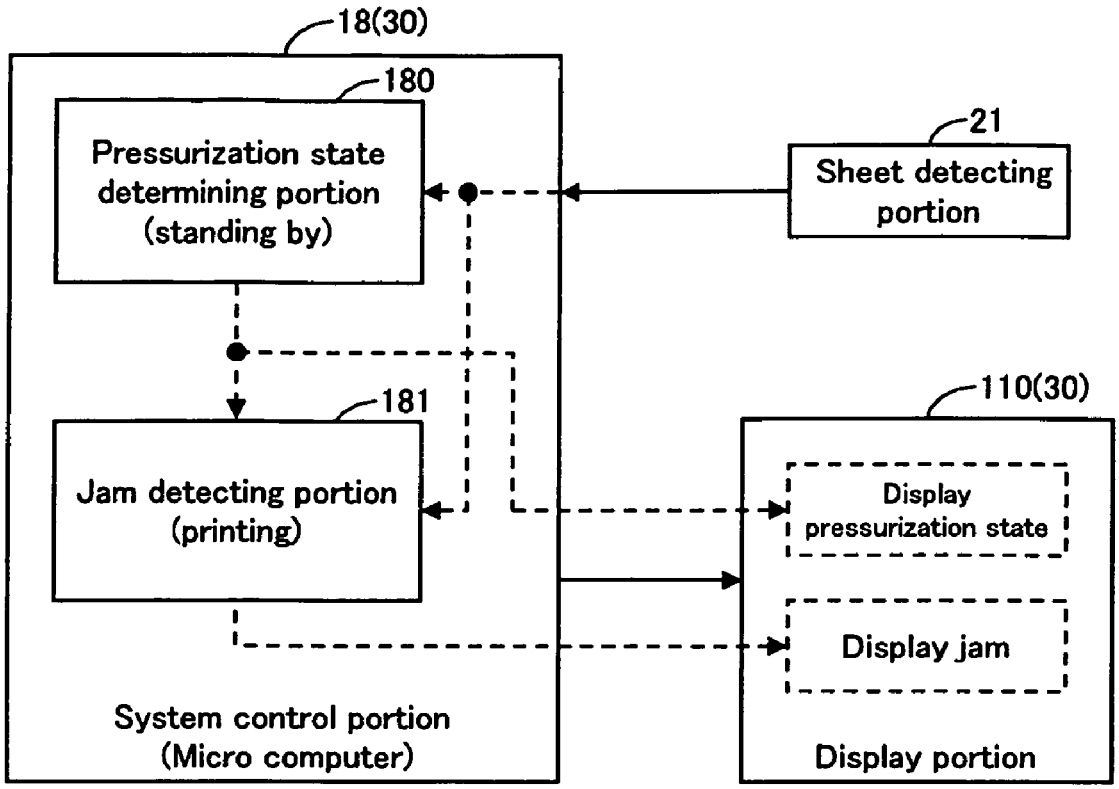
FIG. 1 is a diagram for illustrating a pressurization state determining portion and a pressurization state display portion.

That is, referring to FIG. 1, the system control portion 18 including a jam detecting portion 181 and a display portion 110 provided in the operation portion 11 constitute a jam display portion.

Referring to FIG. 3, the pressure switching mechanism 26 is composed of a dogleg pressure switching lever 26 that is rockable about a pivot 26*a* when handled by an operator at one end.

A pair of pressure switching levers 26 are provided on the front side and rear side of the printer 100 in the longitudinal direction of the fixing roller 23 such that each pressure switching lever 26 at the other end presses one end of the pressurizing lever 25.

When switching the pressurizing force of the pressurizing mechanism 24 and 25 between a strong force and a weak force, the operator opens a cover 19 of the printer 100 and handles the pressure switching mechanism 26.

Figure 4B:
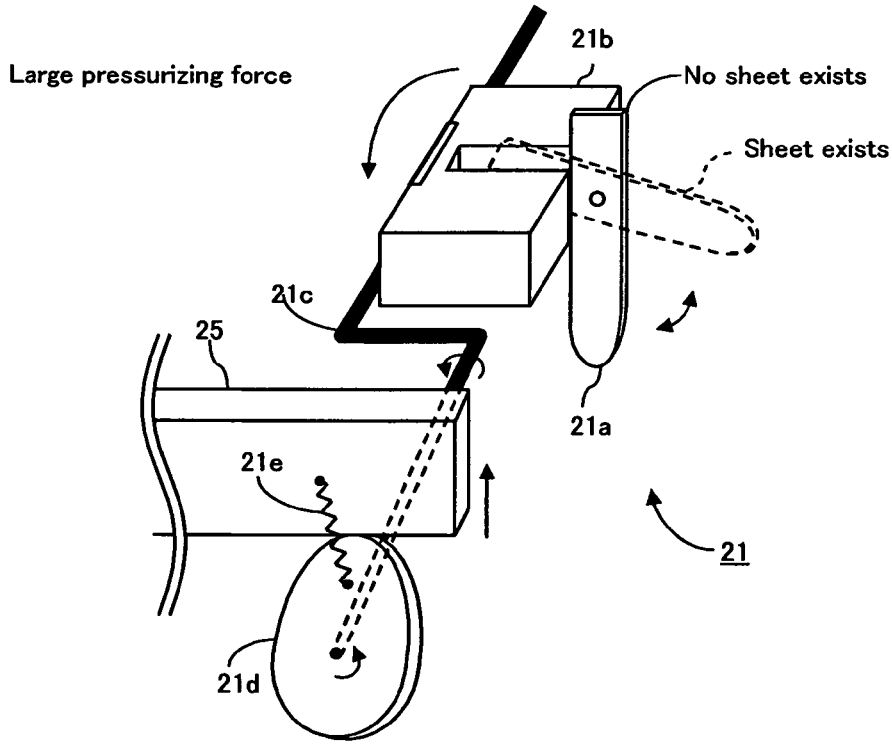
FIG. 4B is a diagram for illustrating the sheet detecting portion in the case of a large pressurizing force.

Referring to FIGS. 3, 4A, and 4B, the photosensor 21*b*, which is a constituent of the sheet sensor 21 located in the vicinity of the fixing portion 20, is mounted to a shaft 21*c* that operates in tandem to a cam 21*d* rotating in tandem to a change in posture of the pressurizing lever 25 so that the posture of the photosensor 21*b* is changed by the cam 21*d*.

The cam 21*d* is located in contact with a lower portion of each of the pair of pressurizing levers 25. The cam 21*d* and the pressurizing lever 25 are pressed into contact with one another by a spring 21*e*. The cams 21*d* are rotatably mounted to both ends of the shaft 21*c*, which is crank-shaped, and the photosensor 21*b* is fixed to the shaft 21*c*.

Upon handling of the pressure switching mechanism 26 by the operator, the pressurizing lever 25 rocks, the cam 21*d* rotates in tandem to the rocking of the pressurizing lever 25, and the shaft 21*c* rotates and the sensor 21*b* turns around the actuator 21*a*.

In the case of printing on special paper such as an envelope, an operation is carried out to lessen the pressurizing force of the pressurizing mechanism 24 and 25 in order to avoid the occurrence of a wrinkle on the special paper at the fixing portion.

Referring to FIG. 4A, when the operator presses the pressure switching mechanism 26 down, the pressurizing lever 25 rocks in a direction to lessen the pressurizing force, that is, in a direction to compress the spring 24, and the surface of the cam 21*d* is biased downward to make the cam 21*d* rotate clockwise by approximately 90°.

In tandem to this operation, the photosensor 21*b* also rotates clockwise by approximately 90° by the torque of the shaft 21*c*, so that the relative locations of the actuator 21*a* and the photosensor 21*b* change.

As a result, referring to FIG. 5A, when no sheet exists on the sheet sensor 21, the actuator 21*a* shields the sensing portion of the photosensor 21*b* from light and the sheet sensor 21 outputs a signal of level "H", while when a sheet exists on the sheet sensor 21, the sensing portion of the photosensor 21*b* is released and the sheet sensor 21 outputs a signal of level In the case of printing on thick paper and plain paper, an operation is carried out to increase the pressurizing force of the pressurizing mechanism 24 and 25 in order to secure sufficient fixing strength at the fixing portion.

Referring to FIG. 4B, when the operator moves the pressure switching mechanism 26 up, the pressurizing lever 25 rocks in a direction to increase the pressurizing force, that is, in a direction to stretch the spring 24, and the surface of the cam 21*d* is biased upward to make the cam 21*d* rotate counterclockwise by approximately 90°.

In tandem to this operation, the photosensor 21*b* rotates counterclockwise by approximately 90° by the torque of the shaft 21*c*, so that the relative locations of the actuator 21*a* and the photosensor 21*b* return to the original ones.

As a result, referring to FIG. 5A, when no sheet exists on the sheet sensor 21, the sensing portion of the photosensor 21*b* is released and the sheet sensor 21 outputs a signal of level "L," while when a sheet exists on the sheet sensor 21, the actuator 21*a* shields the sensing portion of the photosensor 21*b* from light and the sheet sensor 21 outputs a signal of level "H."

The user's handling of the pressure switching mechanism 26 changes the relative locations of the actuator 21*a* and the photosensor 21*b*.

FIG. 4A shows the relative locations of the actuator 21*a* and the photosensor 21*b* in the case of a small pressurizing force, and FIG. 4B shows the relative locations of the actuator 21*a* and the photosensor 21*b* in the case of a large pressurizing force.

That is, the sheet sensor 21 in the vicinity of the fixing portion 20 serves as a sheet detecting portion for changing the detection state of sheet in tandem to the operation of the pressure switching mechanism 26.

This eliminates the need for providing the image forming device with an additional sensor for determining the state of pressurization of the pressurizing mechanism on the fixing portion; the pressurization state is determined and displayed on the basis of an output of the sheet detecting portion for a sheet non-passing time.

As described above, the output logic of the sheet detecting portion 21 for a sheet non-passing time varies depending on the pressurization state of the pressurizing mechanism 24 and 25.

The system control portion 18 determines which level the pressurization state of the pressurizing mechanism 24 and 25 is switched to on the basis of the signal level of the sheet detecting portion 21 for a sheet non-passing time, and displays the determined pressurization state on the display portion 110.

Specifically, when the signal output of the sheet detecting portion 21 for a sheet non-passing time is at level "H," the system control portion 18 determines the pressurizing force of the pressurizing mechanism 24 and 25 to be "small" and displays on the display portion 110 information informing that the pressurizing force is "small," while when the signal output of the sheet detecting portion 21 for a sheet non-passing time is at level "L," the system control portion 18 determines the pressurizing force of the pressurizing mechanism 24 and 25 to be "large" and displays on the display portion 110 information informing that the pressurizing force is "large."

That is, referring to FIG. 1, the system control portion 18 includes a pressurization state determining portion 180 according to the present invention, and the system control portion 18 and the display portion 110 constitute a pressurization state display portion 30 according to the present invention.

Referring to FIG. 5B, when a print starts and the resist sensor 16 detects a sheet conveyed from the paper drawer 14, the resist sensor 16 outputs a signal of level "H," and when the resist rollers 15 are driven and the sheet passes through the resist sensor 16, the resist sensor 16 outputs a signal of level "L."

When the pressurizing force of the pressurizing mechanism 24 and 25 is set at "large," the sheet detecting portion 21 outputs a signal of level "L" in the case where no sheet is detected and outputs a signal of level "H" in the case where a sheet is detected.

When the pressurizing force of the pressurizing mechanism 24 and 25 is set at "small," the sheet detecting portion 21 outputs a signal of level "H" in the case where no sheet is detected and outputs a signal of level "L" in the case where a sheet is detected.

When the signal input from the resist sensor 16 changes from level "H" to level "L" (hereinafter referred to as "resist passing time"), the system control portion 18 activates a timer for detecting jams.

The system control portion 18 stores the output logic of the sheet detecting portion 21 for the resist passing time. When the logic of the signal output from the sheet detecting portion 21 is not inverted and no sheet is detected for a period of time between time $T_{min.}$ and time $T_{max.}$ as indicated by a value on the timer, which starts time counting from the resist passing time, then the system control portion 18 determines this case as an occurrence of a jam. This is because no sheet reaches the sheet detecting portion 21.

When, after a sheet has been detected by the sheet detecting portion 21, the logic of a signal again output from the sheet detecting portion 21 is not inverted before elapse of time $T_{max.}$ as indicated by a value on the timer, which starts time counting from the resist passing time, then the system control portion 18 also determines this case as an occurrence of a jam. This is because sheet passing is not detected.

Thus, the system control portion 18 suitably detects occurrence of a jam also in the configuration where the relative locations of the actuator 21*a* and the photosensor 21*b* change in tandem to operation of the pressure switching mechanism 26.

As used herein, the term "time $T_{min.}$" refers to a time shorter than a shortest time between the resist passing time of the sheet and the time when the trailing edge of the sheet passes through the sheet detecting portion 21 during a no-jamming time, and the term "time $T_{max.}$" refers to a time longer than a longest time between the resist passing time of the sheet and the time when the leading edge of the sheet passes through the sheet detecting portion 21 during a no-jamming time. The values of time $T_{min.}$ and time $T_{max.}$ are predetermined and stored in a ROM of the system control portion 18.

Figure 6:
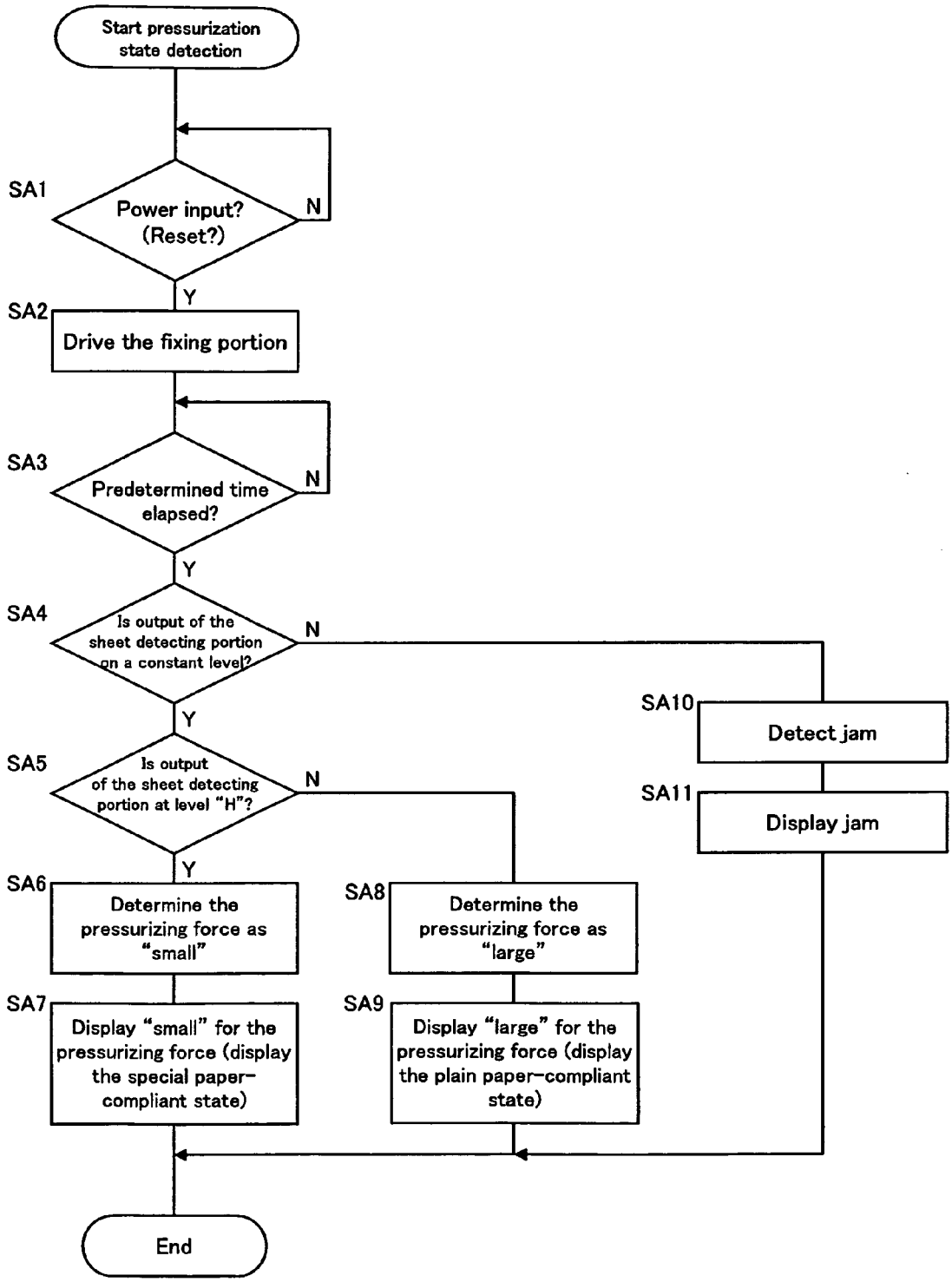
FIG. 6 is a flowchart for describing a pressurization state detection operation and a pressurization state display operation.

The operation of the pressurization state determining portion 180 and the pressurization state display portion 30 will be described by referring to the flowchart shown in FIG. 6.

When power is input to the printer 100, the system control portion 18 controls a motor to drive and rotate the heat roller 22 and the back-up roller 23 (SA1, SA2).

At a predetermined time after the driving of the fixing portion 20 (SA3), when the output level of the sheet detecting portion 21 is constant (SA4) and the output of the sheet detecting portion 21 is at level "H" (SA5), then the pressurization state determining portion 180 determines the pressurizing force of the pressurizing mechanism 24 and 25 to be "small" (SA6), and the pressurization state display portion 30 informs on the display portion 110 that the pressurizing force is "small," that is, the pressurization state is "special paper-compliant" (SA7).

At a predetermined time after the driving of the fixing portion 20 (SA3), when the output level of the sheet detecting portion 21 is constant (SA4) and the output of the sheet detecting portion 21 is at level "L" (SA5), then the pressurization state determining portion 180 determines the pressurizing force of the pressurizing mechanism 24 and 25 to be "large" (SA8), and the pressurization state display portion 30 informs on the display portion 110 that the pressurizing force is "large," that is, the pressurization state is "plain paper-compliant" (SA9).

After elapse of a predetermined time (SA3), when the output level of the sheet detecting portion 21 fluctuates and thus is not constant (SA4), then the jam detecting portion 181 detects a "jam occurrence" (SA10), and the jam display portion informs the "jam occurrence" on the display portion 110 (SA11).

The "jam occurrence" detected by the jam detecting portion 181 is because the fluctuation of the output level of the sheet detecting portion 21 may indicate that the posture of the actuator 21*a* of the sheet detecting portion 21 is not constant, that is, a sheet exists.

Figure 7:
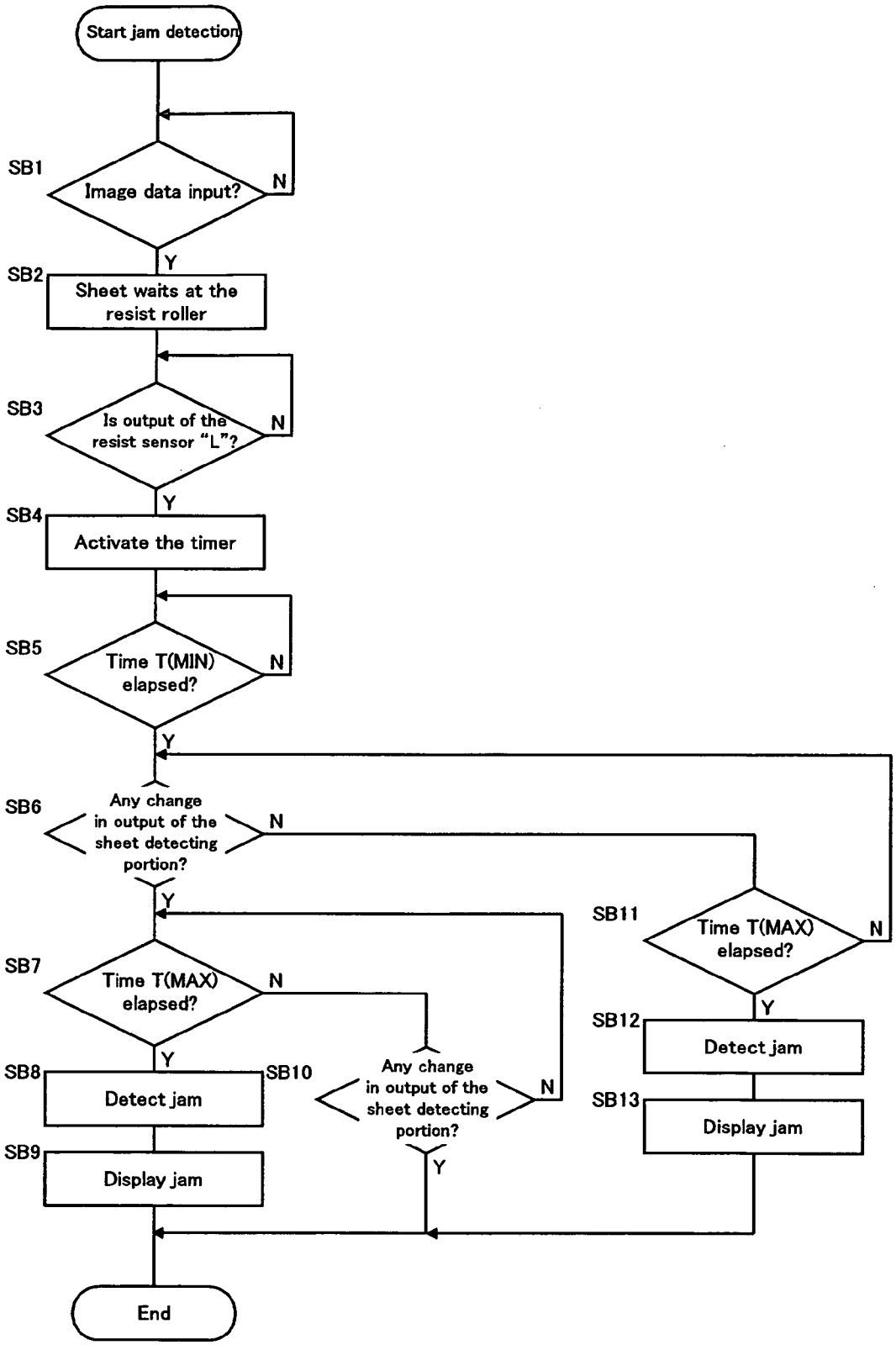
FIG. 7 is a flowchart for describing a jam detection operation.

The operation of the jam detecting portion 181 and the jam display portion during the sheet passing time will be described by referring to the flowchart shown in FIG. 7.

When image data is input to the printer 100, the printer 100 starts a print (SB1). When a sheet conveyed from the paper drawer 14 is kept waiting for correction of its leading edge at the resist rollers 15 (SB2), and the resist rollers 15 are driven and the trailing edge of the sheet passes through the resist sensor 16, and the output of the resist sensor 16 changes from level "H" to level "L" (SB3), then the system control portion 18 activates the timer (SB4).

After elapse of time $T_{min.}$ as counted by the timer (SB5), when the output logic of the sheet detecting portion 21 changes upon conveyance of a sheet (SB6) and no other sheets pass and thus the output logic of the sheet detecting portion 21 does not change again before elapse of time $T_{max}$ (SB7, SB10), then the jam detecting portion 181 detects a "jam occurrence" (SB8), and the jam display portion informs the "jam occurrence" on the display portion 110 (SB9).

After elapse of time $T_{min.}$ as counted by the timer (SB5), when the output logic of the sheet detecting portion 21 changes (SB6) and the output logic of the sheet detecting portion 21 changes again before elapse of time $T_{max}$ (SB7, SB10), this indicates suitable sheet conveyance, and therefore, the jam detecting portion 181 detects no "jam occurrence" and the jam display portion does not inform "jam occurrence" on the display portion 110.

After elapse of time $T_{min.}$ as counted by the timer (SB5), when the output logic of the sheet detecting portion 21 does not change because of no sheet conveyance (SB6) and time $T_{max}$ elapses (SB11), then the jam detecting portion 181 detects a "jam occurrence" (SB12), and the jam display portion informs the "jam occurrence" on the display portion 110 (SB13).

Another embodiment will be described below.

While in the above embodiment description is made of the case where the present invention is applied to the printer 100, the present invention also finds application in any electrophotographic image forming devices having fixing portions of the heat roller type such as copiers and facsimiles, as well as printers.

Figure 8:
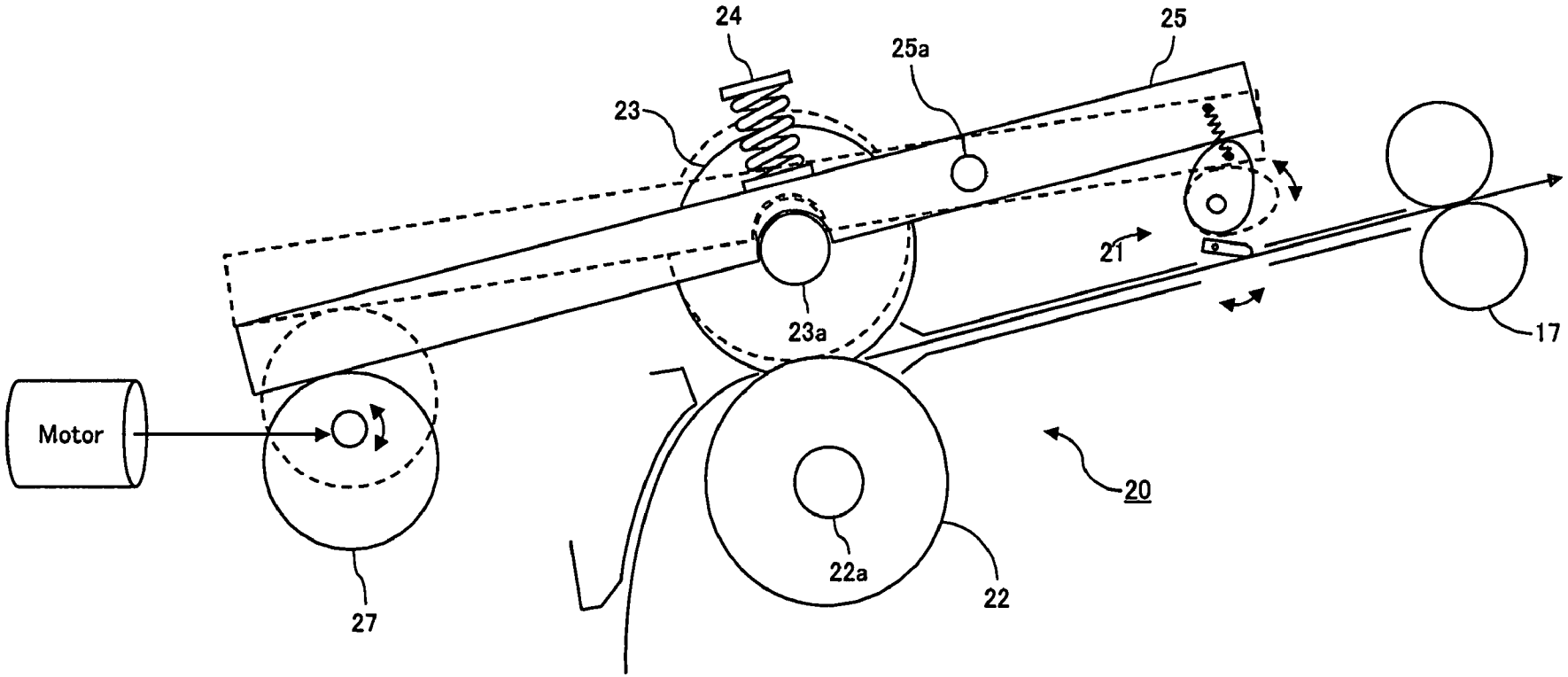
FIG. 8 is a diagram for illustrating a fixing portion according to another embodiment of the present invention.

While in the above embodiment description is made of a pressure switching mechanism composed of a pair of pressure switching levers 26 operated by manual handling of the operator, the pressure switching mechanism may be composed of a pair of motor-driven, eccentric cams 27, as shown in FIG. 8.

While in the above embodiment description is made of the configuration where the photosensor 21*b* rotates in tandem to the operation of the pressure switching mechanism 26 to change the relative locations of the actuator 21*a* and the photosensor 21*b*, it is also possible to rotate the actuator 21*a* in tandem to the operation of the pressure switching mechanism 26 to change the relative locations of the actuator 21*a* and the photosensor 21*b*.

Figure 9A:
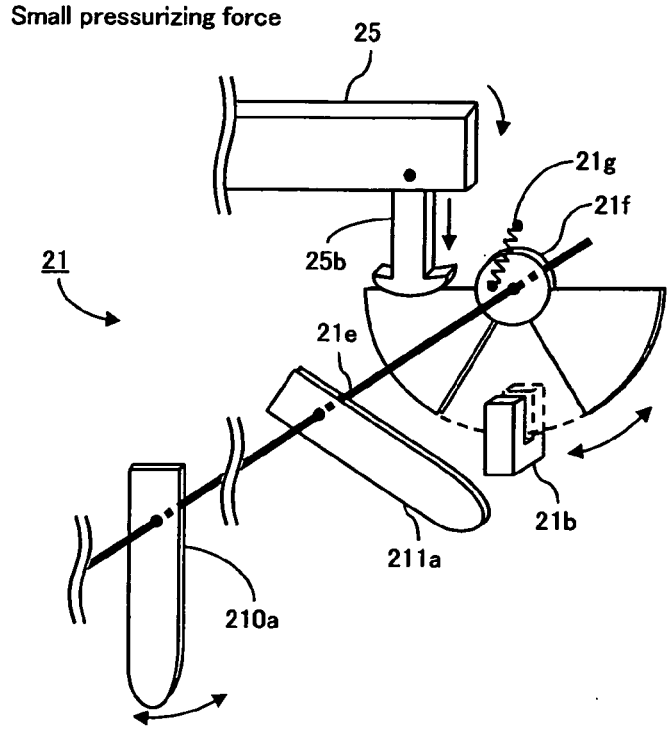
FIG. 9A is a diagram for illustrating the sheet detecting portion in the case of a small pressurizing force according to another embodiment of the present invention.
Figure 9B:
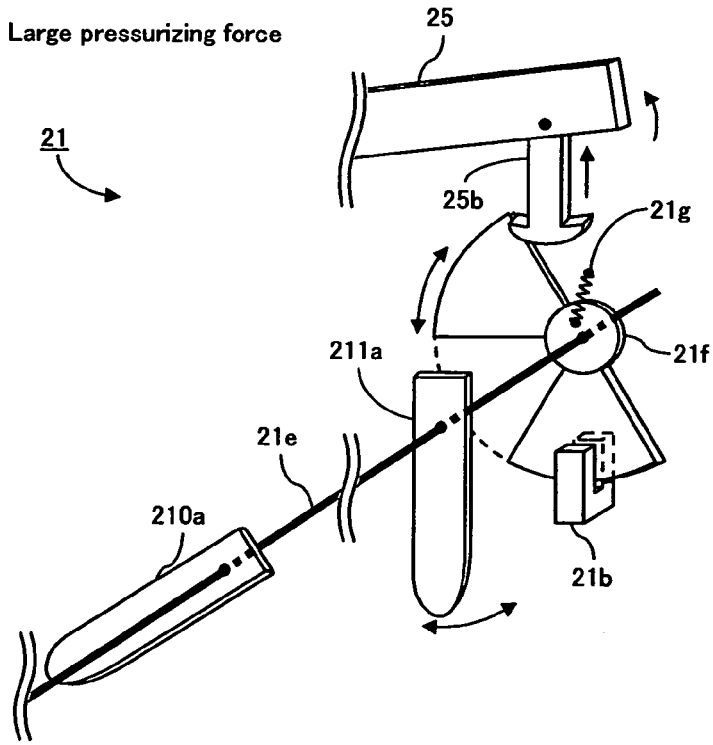
FIG. 9B is a diagram for illustrating the sheet detecting portion in the case of a large pressurizing force according to the other embodiment of the present invention.

This is realized by the sheet detecting portion 21 shown in FIGS. 9A and 9B. The sheet detecting portion 21 includes actuators 210*a* and 211*a* that contact special paper such as an envelope and plain paper conveyed to the fixing portion 20, and an actuator 21*f* that is fixed on a shaft 21*e* about which the actuators 210*a* and 211*a* rotate and that shields or releases the sensing portion of the photosensor 21*b* in accordance with a change in the posture of the actuators 210*a* and 211*a*.

In this case, the pressurizing levers 25 each may be provided with an auxiliary lever 25*b* thereunder so that in tandem to the operation of the pressure switching mechanism 26, the auxiliary lever 25*b* presses the actuator 21*f* to cause it to rotate.

The postures of the actuator 210*a* and the actuator 211*a* are adjusted in order to avoid simultaneous contact to the sheet on the sheet convey pathway, which may obstruct sheet conveyance.

Referring to FIG. 9A, when the pressurizing force of the pressurizing mechanism 24 and 25 is set small, the auxiliary lever 25*b* presses the actuator 21*f* downward to cause it to rotate counterclockwise. This makes the posture of the actuator 210*a* vertically oriented and releases the sensing portion, thereby turning the output of the photosensor 21*b* into level "L."

When the posture of the actuator 210*a* is inclined to a sheet discharge direction by contact to a conveyed sheet, the actuator 21*f* is rotated counterclockwise on a shaft 21*e* to shield the sensing portion, thereby turning the output of the photosensor 21*b* into level "H."

After the sheet has passed, the actuator 21*f* is rotated clockwise by the recovering force of a spring 21*g* that has one end fixed to the image forming device and the other end fixed to the actuator 21*f*, and is stopped by contact to the auxiliary lever 25*b*.

Here a suitable recovering force is selected for the spring 21*g* through experiments because if the recovering force is too strong the conveyed sheet cannot change the postures of the actuators 210*a* and 211*a*, creating a possibility of damaging the sheet.

Referring to FIG. 9B, when the pressurizing force of the pressurizing mechanism 24 and 25 is set large, the auxiliary lever 25*b* withdraws upward and the actuator 21*f* is rotated clockwise by the recovering force of the spring 21*g* and stopped at the point of contact to the auxiliary lever 25*b*. This makes the posture of the actuator 211*a* vertically oriented and shields the sensing portion, thereby turning the output of the photosensor 21*b* into level When the posture of the actuator 210*a* is inclined to the sheet discharge direction by contact to a conveyed sheet, the actuator 21*f* is rotated counterclockwise by the torque of the shaft 21*e* to release the sensing portion, thereby turning the output of the photosensor 21*b* into level "L."

After the sheet has passed, the actuator 21*f* is rotated clockwise by the recovering force of the spring 21*g* and stopped by contact to the auxiliary lever 25*b*.

As described above, the actuator 21*f* may rotate in tandem to the operation of the pressure switching mechanism 26 to change the relative locations of the actuator 21*f* and the photosensor 21*b*. Since the output logic of the sheet detecting portion 21 for the sheet non-passing time is reversed in accordance with the pressure switching state, the pressurization state determining portion 180 can determine the state of pressurization of the pressurizing mechanism 24 and 25 on the basis of the output of the sheet detecting portion 21.

The above embodiments have been described by way of example and will not limit the present invention; it will be appreciated that various modifications can be made to the specific details of the constituent parts of the present invention without departing from the scope of the present invention.

What is claimed is:

1. An image forming device including a fixing portion including a nip that is formed between a heat roller and a back-up roller pressurized by a pressurizing mechanism and holds and conveys a toner-bearing sheet, the image forming device comprising:

a pressure switching mechanism for changing a pressurizing force of the pressurizing mechanism to change the pressurizing force applied to the toner-bearing sheet by the heat roller and the back-up roller from a first force level applying pressure to the toner-bearing sheet and a second force level applying pressure to said toner-bearing sheet, said pressurizing force being applied to said toner-bearing sheet while conveying the toner-bearing sheet through the fixing portion;

a sheet detecting portion for detecting a sheet conveyed to the fixing portion and for changing a sheet detection logic of an output signal indicating sheet presence based on a switching state of pressure by the pressure switching mechanism being such as to apply said first force level or said second force level;

a pressurization state determining portion for determining a state of pressurization of the pressurizing mechanism on the basis of an output logic of the sheet detecting portion; and a pressurization state display portion for displaying the pressurization state determined by the pressurization state determining portion.

2. The image forming device according to claim 1, wherein the pressurization state determining portion determines the state of pressurization of the pressurizing mechanism on the basis of an output logic of the sheet detecting portion for a sheet non-passing time.

3. The image forming device according to claim 1, wherein the sheet detecting portion includes an actuator activated by the sheet conveyed to the fixing portion and a sensor for detecting a posture of the actuator, relative locations of the actuator and the sensor being changed on the basis of the switching state of pressure by the pressure switching mechanism.

4. The image forming device according to claim 3, wherein:

the pressure switching mechanism is composed of a hand operable pressure switching lever; and the image forming device comprises a cam mechanism for changing an installment posture of the sensor in tandem to operation of the pressure switching lever.

* * * * *

UNITED STATES PATENT AND TRADEMARK OFFICE

CERTIFICATE OF CORRECTION

PATENT NO. : 8,073,351 B2
APPLICATION NO. : 12/319257
DATED : December 6, 2011
INVENTOR(S) : Hitoshi Hayamizu It is certified that error appears in the above-identified patent and that said Letters Patent is hereby corrected as shown below:

At column 5, line 13: insert -- L. -- after "level" so as to read -- level "L." --, and thereafter, insert a paragraph break so that the next paragraph begins, "In the case of printing".

At column 9, line 4: insert -- H. -- after "level" so as to read -- level "H." --.

Signed and Sealed this
Twenty-second Day of May, 2012

David J. Kappos

David J. Kappos
*Director of the United States Patent and Trademark Office*